United States Patent [19]

Elhaus

[11] 4,153,236

[45] May 8, 1979

[54] PREHEATING FURNACE

[76] Inventor: Friedrich W. Elhaus, Hofkamp 140, Wuppertal, Fed. Rep. of Germany

[21] Appl. No.: 825,099

[22] Filed: Aug. 16, 1977

[30] Foreign Application Priority Data

Aug. 20, 1976 [DE] Fed. Rep. of Germany ..... 2637646

[51] Int. Cl.[2] ..... C21D 9/70

[52] U.S. Cl. ..... 266/252; 34/160; 266/259; 432/144

[58] Field of Search ..... 34/107, 160; 266/249, 266/99, 251, 252, 259; 432/8, 18, 128, 143, 144, 145, 146, 150, 171, 176

[56] References Cited

U.S. PATENT DOCUMENTS

| | | | |
|---|---|---|---|
| 2,009,078 | 7/1935 | Ziska | 34/160 X |
| 3,390,871 | 7/1968 | McLean et al. | 266/106 X |
| 3,837,794 | 9/1974 | Phillips | 432/8 |
| 3,841,614 | 10/1974 | Okuno | 432/171 X |
| 3,868,094 | 2/1975 | Hovis | 266/252 X |
| 4,065,249 | 12/1977 | Nelson | 432/8 |

FOREIGN PATENT DOCUMENTS

| | | | |
|---|---|---|---|
| 1807504 | 11/1978 | Fed. Rep. of Germany | 266/261 |

*Primary Examiner*—Roy Lake
*Assistant Examiner*—Paul A. Bell
*Attorney, Agent, or Firm*—James B. Blanchard; Gary M. Ropski

[57] ABSTRACT

A preheating furnace having a furnace chamber for preheating an extended metal piece, comprising a transportation means for the metal arranged in the furnace chamber, at least one treatment chamber in the furnace chamber for containing and treating the metal; at least one pressure chamber in the furnace chamber into which hot gas is blown under pressure; and a plurality of rows of slot-type nozzles arranged laterally symmetrically from the metal and extending through a partition which subdivides the furnace chamber into the treatment chamber and the pressure chamber. The slot-type nozzles adduct hot gas to the metal so that warping of the metal is prevented, and the nozzles have elongated openings disposed with the longer axis of each opening transverse to the longitudinal axis of the metal.

According to an alternative embodiment of the invention, there is provided a furnace group including a first preheating furnace and a second preheating furnace connected downstream adjacent the first furnace so that the exhaust gases of the second furnace provide hot gases for preheating the metal in the first furnace, wherein at least the first furnace is of the type previously defined above.

6 Claims, 11 Drawing Figures

PREHEATING FURNACE

Figure 1:
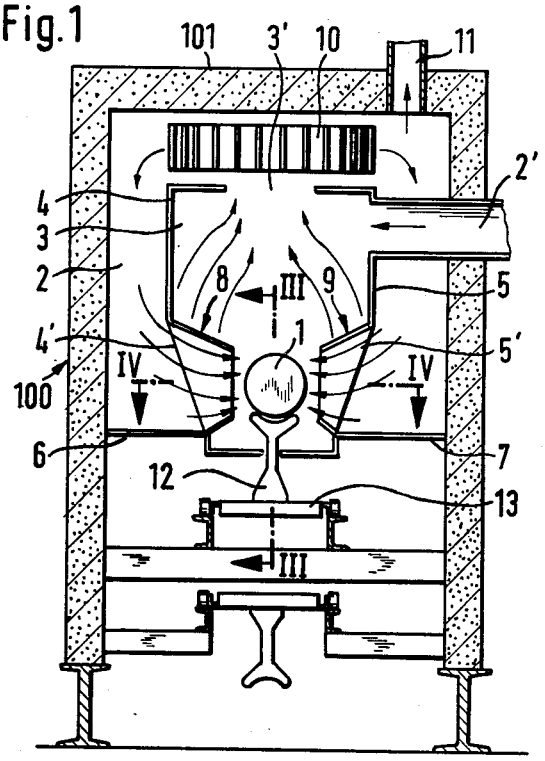

The invention relates to a preheating furnace for preheating extended metal pieces, in particular single ingots, bars, or billets of light metal, such as aluminum and its alloys, comprising a transportation means arranged in the furnace chamber for the material and nozzles which are arranged laterally of the material and have their openings directed toward the surface of the material and through which hot gas is adducted to the material.

A furnace of this kind is known from German Pat. No. 1,807,504 with which the devices for preheating the material are rows of burners from which flames impinge directly on the material.

Furnaces comprising slot-type nozzles directed toward the material and through which circulated hot gas is adducted to the material are known on principle (journal "Gas-Wärme-International", vol. 20, no. 4, April 1971, pages 145 to 150 and vol. 23, no. 1, January 1974, pages 8 to 12). One proposal put to practice provides for the slot-type nozzles to extend in longitudinal direction of the material along the entire furnace length (DT-OS No. 2,620,111).

Likewise known is a heat treatment furnace with continuous operation, comprising two preheating zones. In the first preheating zone the material is heated without contact with combustion gases, whereas in the second preheating zone it is raised to a heat treatment temperature in contact with combustion gases (DT-OS No. 1,558,788).

It is the object of the invention to provide a preheating furnace of the kind described, in which the material, in particular singled material, such as ingots, bars, or billets can be heated with the least possible fuel consumption in a rapid, uniform, and economical manner from the cold state to a desired temperature, so as to be prepared for further treatment, especially further heating to a desired final temperature.

To solve the problem specified, it is provided in accordance with the invention that, in a preheating furnace of the kind described, rows of slot-type nozzles are arranged symmetrically with respect to the material so as to admit circulated hot gas to the material in such manner that warping of the material is prevented, and the elongated openings of the slot-type nozzles of the rows are disposed with their longitudinal extension transversely of the longitudinal axis of the material.

The desired symmetrical admission of hot gas to prevent warping of the material as a consequence of uneven heating is achieved in a preferred, structurally very simple embodiment of the invention by the provision of two rows of slot-type nozzles which are arranged such that they admit hot gas to the material, which is acted upon in one path, substantially symmetrically with respect to two cross sectional main axes of the material extending vertically relative to each other.

The novel furnace may be designed for continuous or stationary operation. The material can be heated while in motion or at rest which, surprisingly, is effected just as quickly as with the known furnace (German Pat. No. 1,807,504) yet at fuel savings, i.e. a higher degree of efficiency. Another essential advantage of the novel furnace is to be seen in the fact that any kind of energy can be chosen for heating, heating by oil, coal, gas or electrical energy in particular being permissible. And measures can be taken from the start for two different kinds of heating, without involving much extra expenditure, such as gas and electricity. Subsequent adaptation to heating by a different source of energy, should the one type of energy become too scarce or too expensive, is likewise possible without any difficulty.

The material may be oriented with its longitudinal axis transversely of the direction of transportation or in the direction of transportation.

The degree of heating and its uniformity are decisively influenced by the determination of the circulating quantity of hot gases and of the dimensions of the slot-type nozzles as well as the spacings between the individual nozzles and between them and the material. In this respect it is particularly favorable if the spacing between adjacent slot-type nozzles in a row is so selected that an undisturbed return flow of the hot gases issuing from the nozzles is guaranteed in the return flow passages formed between the slot-type nozzles. With a round billet, for instance, this spacing may correspond approximately to half the diameter of the billet. Furthermore, the width of the openings of the slot-type nozzles should be from $\frac{1}{3}$ to 1/10 of the spacing mentioned, preferably being $\frac{1}{8}$ thereof. With such dimensions high mean heat transfer coefficients $\alpha$ of up to approximately 200 kcal/m$^2$h° C. (40.80 BTU/sq.ft. h° F.) can be achieved. Furthermore, it proved advantageous for the transverse distance between the openings and the surface of the material to be at least approximately 30 mm and for the openings of the slot-type nozzles to have a length which equals the height of the laterial projection of the material, preferably being greater. It is convenient, especially with material of circular cross sectional shape, for the slot-type nozzles to be designed so as to converge toward the material.

In an advantageous structural modification of the furnace it is provided that the slot-type nozzles of the or each row extend through a partition which subdivides the furnace chamber into at least one treatment chamber, which contains the material and into which the slot-type nozzles open, and at least one pressure chamber. In the case of electrical heating the electrical heaters are arranged in this pressure chamber. The furnace thus heated requires neither inlets nor outlets for hot gases, in other words, the furnace atmosphere is circulated without any outside influence. If the heating is provided by fuel or by exhaust gas, for example from another furnace, it is convenient to provide the furnace with at least one gas inlet channel and an outlet for the hot gases. The furnace may be subdivided into several circulating zones, in particular by partitions. Also, the furnace may comprise one or more heating zones, each with its own heating, ventilation, and temperature control. This may be convenient also for stationary operation because it permits individual temperature adjustment in the individual heating zones, for example in order to balance local disturbances. However, with continuous operation and subdivision into a plurality of heating zones a special advantage is obtained in that the rated temperature is adjustable incrementally in the direction of transportation. In accordance with an especially important further development of the invention the temperature of the material is utilized as a regulating entity in the temperature control and is measured directly at the material.

The preheating furnace according to the invention may be used alone in the preheating of material, and it may be heated in any of the above described manners by all kinds of energy.

Preferred use of the preheating furnace is in a furnace group for quick preheating of metal pieces. In this arrangement the furnace is connected upstream of another similar or different quick-preheating furnace (German Pat. No. 1,807,504), the exhaust gases of which constitute the hot gases for preheating the material. In this case, a common transportation means is provided which runs through both furnaces. The furnace group mentioned affords especially rapid and, at the same time, energy saving preheating of the material since the exhaust gases of the downstream preheating furnace, as seen in the direction of transportation, are utilized for heating the upstream preheating furnace. Without any noticeable additional energy expenses this permits preheating of the material before it enters the downstream preheating furnace so that the preheating process proper can be effected in less time.

Figure 1A:
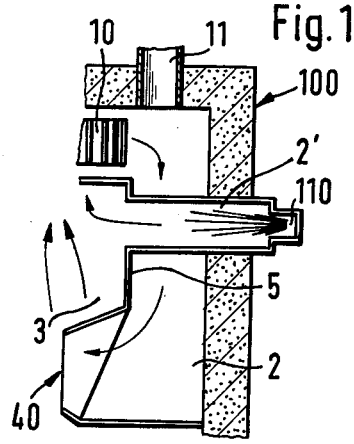
Figure 1B:
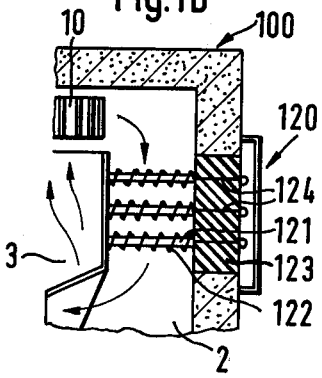
Figure 2:
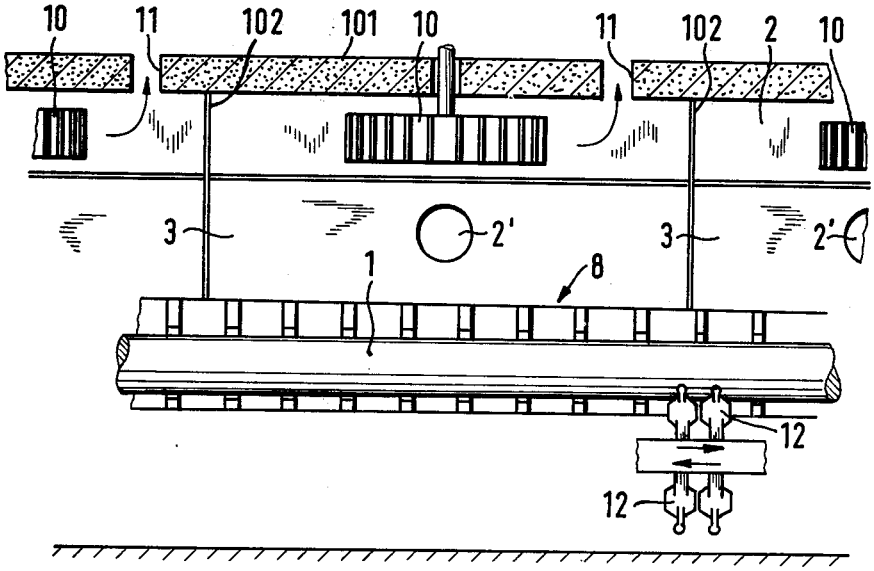
Figure 3:
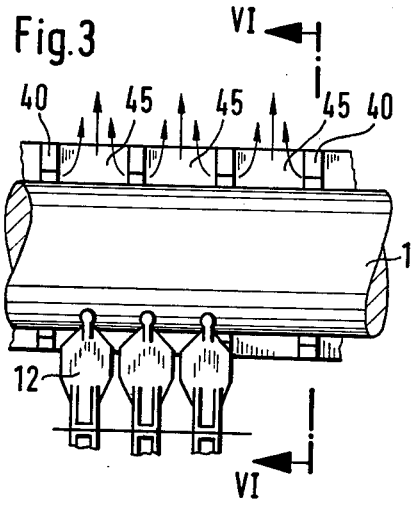
Figure 4:
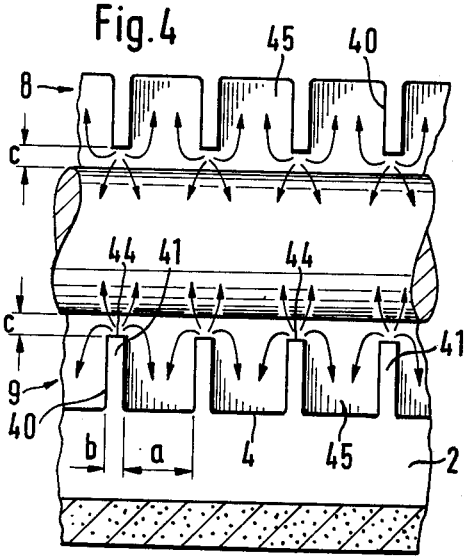
Figure 5:
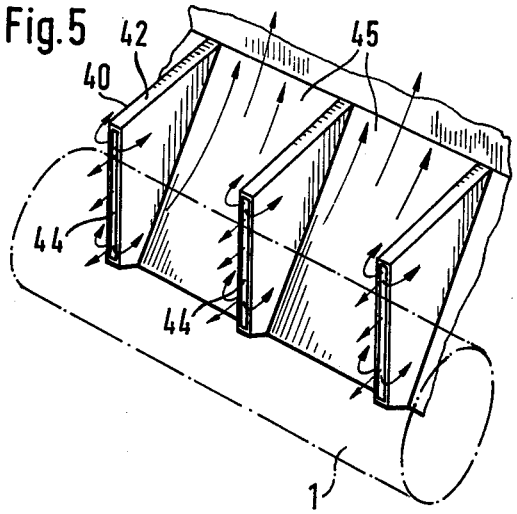
Figure 6:
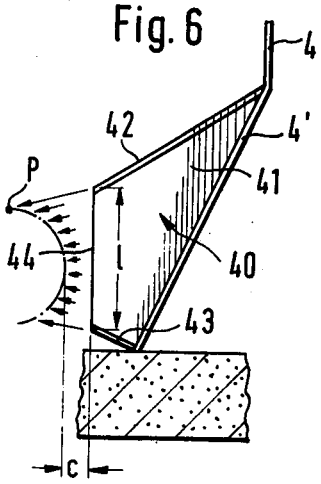
Figure 7:
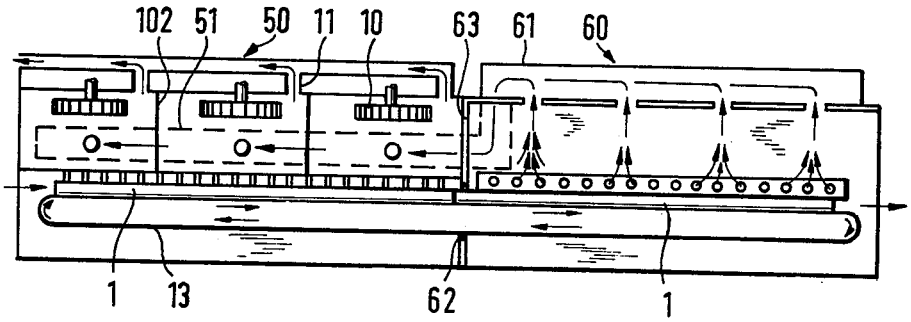
Figure 8:
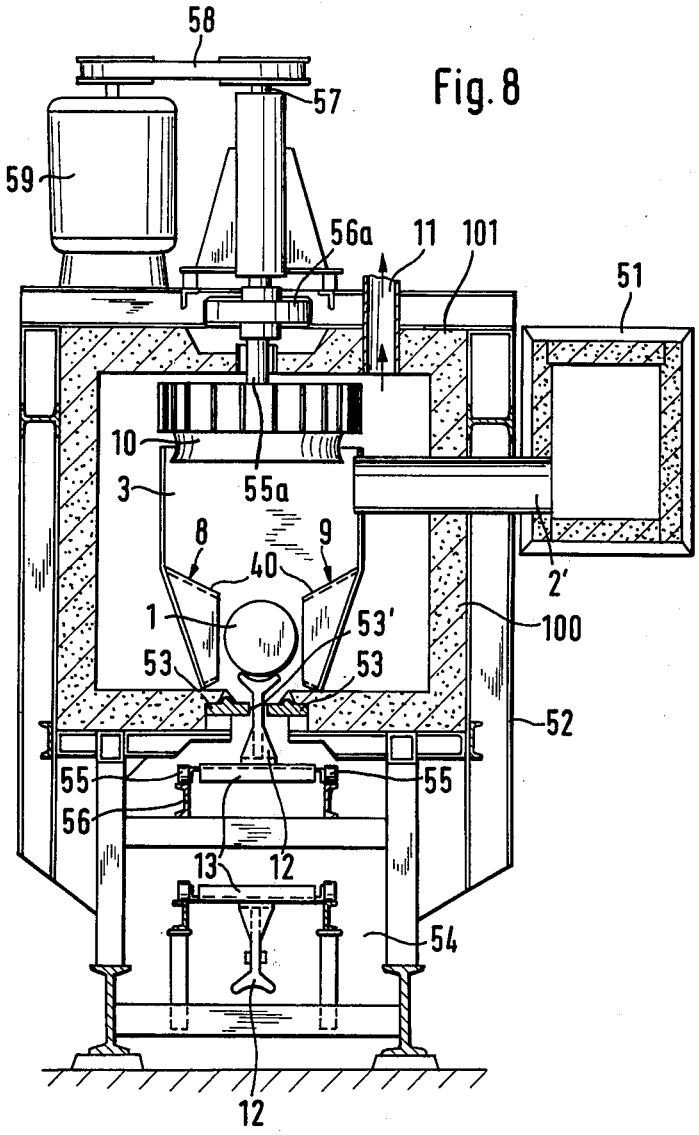
Figure 9:
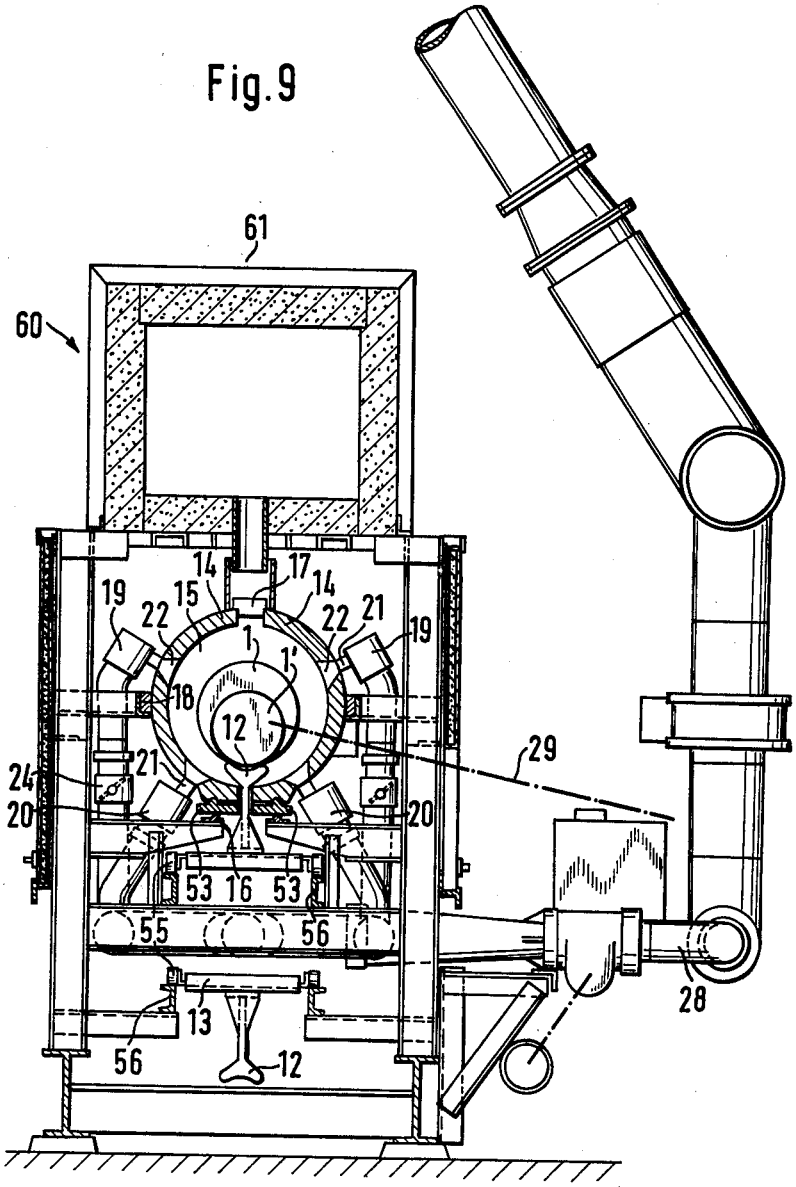

The invention will described further, by way of example, with reference to the accompanying drawings, in which:

FIG. 1 is a diagrammatic cross sectional elevation of a preheating furnace according to the invention, FIG. 1*a* is a part sectional elevation of the furnace shown in FIG. 1 with a modification, FIG. 1*b* is a part sectional elevation of the furnace shown in FIG. 1 with another modification, FIG. 2 is a part longitudinal sectional elevation of the furnace shown in FIG. 1, FIG. 3 is a part sectional elevation along line III—III of FIG. 1, FIG. 4 is a part sectional elevation along line IV—IV of FIG. 1, FIG. 5 is a perspective part elevation from the inside of a row of slot-type nozzles of the furnace according to FIGS. 1 to 4, FIG. 6 is a part sectional elevation along line VI—VI of FIG. 3, FIG. 7 shows a furnace assembly comprising a continuous-operation preheating furnace according to the invention upstream of a quick-preheating furnace, FIGS. 8 and 9 are cross sectional elevations of a structural embodiment of a furnace assembly according to FIG. 7, on an enlarged scale, i.e. FIG. 8 a cross section of the lefthand furnace and FIG. 9 a cross section of the right hand furnace as shown in FIG. 7.

The preheating furnace shown in FIGS. 1 to 6 comprises an outer casing 100 of refractory brick inside of which there is a pressure chamber 2 and a treatment chamber 3. Lateral partitions 4, 5 and bottom walls 6, 7 separate the pressure chamber 2 from the treatment chamber 3. Communication between the pressure chamber 2 and the treatment chamber 3 is essentially established by two rows 8, 9 of slot-type nozzles 40, each of which rows is arranged in a lower inwardly bent area 4', 5' of the respective lateral partition 4, 5. The structure and arrangement of the rows 8, 9 of slot-type nozzles will be described further with reference to FIGS. 3 to 6. The rows 8, 9 are arranged at either side of the path of movement of billets 1 to be heated which are being transported through the treatment chamber 3 by carrier devices 12 of a double-run conveyor chain 13. A gas inlet passage 2' supplies hot gas to the treatment chamber 3. An escape or outlet 11 for part of the hot gases passes through the ceiling 101 of the furnace. The gas inlet passage may be connected to the gas discharge end of another preheating furnace (e.g. furnace 60 according to FIG. 9).

According to FIG. 1*a* a gas or oil burner may open into the outer closed end of the gas inlet passage 2'.

According to FIG. 1*b* the furnace may also be provided with an electrical heating system 120 in the form of an electrical resistance radiator having insulating bars 121 around which current carrying heater coils 122 are wound and which extend transversely across the pressure chamber to the partitions 4, 5 (only one side of the furnace with partition 5 being shown). The heater coils are energized by lines which pass through an insulating plug 123. In this case a gas inlet passage and outlet 11 may be dispensed with. The furnace atmosphere is totally enclosed.

The treatment chamber 3 has an upper longitudinal aperture 3' above which an exhaust fan 10 is arranged. Finally, the outlet 11 for the hot gases is provided in the ceiling 101 of the outer casing of the furnace.

FIG. 2 shows that the furnace is axially subdivided into a plurality of zones having corresponding treatment chambers 3 and associated gas inlet chambers 2, the partitions required for axial subdivision being designated by reference numeral 102. A separate fan 10 and, if desired, a gas inlet passage 2' and an outlet 11 are coordinated with each treatment chamber.

The design of the slot-type nozzles of rows 8, 9 will now be described more particularly with reference to FIGS. 3 to 6.

In the figures the slot-type nozzles are designated by reference numerals 40. The slot-type nozzles 40 extend from the inclined lower wall sections 4' and 5', respectively, inwardly into the treatment chamber 3 and comprise sidewalls 41, topwalls 42, bottomwalls 43, and elongate openings 44 which are disposed vertically and face the path of movement of the material being moved past them. The top surface 42 and the bottom surface 43 are inclined with respect to each other such that a flow of hot gases issuing from opening 44 converges toward the material, as seen in FIG. 6.

The length 1 of the nozzle opening 44 is so selected and the nozzle is so arranged that the hot gases discharged are sprayed fully over that half of the circumference which faces the nozzle. The length 1 of the opening 44 of the nozzle conveniently is chosen such that the upper outer edge of the gas jet passes through point P rather than above the same so as to avoid an unnecessary and unfavorable turbulence with the corresponding jet being discharged by the opposed nozzle (see FIG. 4, not shown in FIG. 6). The length 1 may also be greater than shown in FIG. 6, with a corresponding steeper inclination of the top surface 42 in order to prevent the upper edge of the gas jet from passing beyond point P. Also the bottom surface 43 is conveniently inclined, yet in upward direction and at a smaller angle (FIG. 6).

According to FIG. 4 the axial spacing a between adjacent slot-type nozzles arranged in the rows 8, 9 corresponds approximately to half the diameter of the billets to be heated. The width b of the nozzles is between one eighth and one tenth of the axial spacing a, preferably being approximately one eighth. The transverse spacing c between the openings 44 of the nozzles and the material 1 to be treated is no less than 30 mm and no more than 100 mm.

In an embodiment in which the diameter of billets to be heated is in the order of 300 mm, the axial spacing $a = 100$ mm, the nozzle width $b = 13$ mm, and the transverse spacing $c = 30$ to 50 mm. With such dimensions, of course, the billet diameter may also be smaller down to the smallest usual billet diameters or greater than 300 mm.

Not only the surface but also the velocity at which the heat is transported to or at said surface is decisive for optimum heat transfer. Decisive for this velocity is the cross section of the opening 44 of the nozzle and the circulating quantity. A person skilled in the art is able to choose the optimum values for the dimensions mentioned and for the circulating quantity so that a very high heat transfer coefficient $\alpha \approx 200$ kcal/m$^2$h° C. (40.80 BTU/sq.ft.h° F.) is obtained.

The circulating quantity can be obtained by proper choice and design of the fans 10. In practice the fans in each preheating zone between the partitions 102 (FIG. 2, FIG. 7) produce pressure differentials of approximately 300 mm of water, high pressure being established in pressure chamber 2 and low pressure in treatment chamber 3. With the dimensions of the slot-type nozzles 40 described in the example of figures the outlet velocities of the hot gases will then be in the order of from 50 to 70 m/sec. (111.845 to 156.583 miles/h.).

The furnace assembly shown in FIG. 7 serves for quick preheating of material to be preheated in continuous operation and comprises a furnace which, on principle, has the same structure as the furnace according to FIGS. 1 to 6 and is shown in the left half of FIG. 7 and in FIG. 8 and in general designated by reference numeral 50, as well as a quick-preheating furnace of known structure which is shown in the right half of FIG. 7 and in FIG. 9 and designated in general by reference numeral 60.

The structural elements of furnace 50 already described in connection with FIGS. 1 to 6 are designated by the same reference numerals in FIG. 8 for the sake of simplicity and described once again only as far as necessary. FIG. 8 shows some additional details which are required for the structural embodiment and for connection to the quick-preheating furnace 60. An essential detail in this arrangement is a gas conduit 51 which is insulated by a casing of refractory brick and from which the gas inlet passages 2' toward the treatment chamber 3 part and which is connected to a gas exhaust passage 61 of the quick-preheating furnace 60. Thus furnace 50 is heated by exhaust gases of quick-preheating furnace 60.

FIG. 8 shows further details of furnace 50 which is shown more diagrammatically in FIG. 1. Thus FIG. 8 shows a steel structure designated in general by reference numeral 52 and serving to hold together the outer casing of the furnace.

Especially important for the furnace described when used alone or in combination with another preheating furnace are sealing strips 53 of gray cast iron which are arranged at either side of the carrier devices 12 extending upwardly from the double-run conveyor chain 13 and which are inserted into the bottom wall 6, 7 extending along the furnace. These sealing strips afford good sealing between the treatment chamber 3 in which there is high pressure and the space 54, in which the conveyor chain 13 is received and which communicates with atmosphere. At the same time, the sealing strips serve for lateral guidance of the conveyor chain 13 or its carrier devices 12. The sealing strips are designed as slotted seals, and the sealing faces 53' facing the conveyor chain 13 fulfill their sealing and guiding function even without being machined. As the conveyor chain 13 is guided by the sealing strips the otherwise customary guide collars on rollers 55 of the conveyor chain 13, by means of which the chain rolls off rails 56 may be dispensed with.

FIG. 8 also shows the drive means of the fan which drives the shaft 55 of the fan passing upwardly through the sealing 101 of the outer casing 100 of the furnace. The drive mans comprises a coupling mechanism 56, the drive shaft 57 of which is driven by an electric motor 59 via a belt drive 58. The length of furnace 50 as well as that of furnace 60 is such that an ingot or billet of the greatest length occurring in practice (7 to 8 m) fits into it lengthwise.

The double-run conveyor chain 13 extends through an opening 62 in a partition 63 (FIG. 7) between the two furnaces 50, 60 into the quick-preheating furnace 60 and also extends through the latter in lengthwise direction. In the quick-preheating furnace 60 the carrier devices 12 project through a longitudinal gap into the cylindrical furnace chamber 15 formed by two furnace shells 14. The furnace shells are each supported by their lower ends for tilting movement on a carrier rail 16 and are held together at the top by spacers 17. Laterally the furnace shells are supported at the furnace wall by radial supporting bars 18. By removal of the spacers 17 and slight tilting inwards around the supporting points at the carrier rails 16 the furnace shells 15 can be dismantled without any difficulty.

The furnace shells 14 have four radially directed rows of openings 22 into which open nozzles 21, likewise directed radially, of premixture burners 19, 20. The radially directed rows of burners extend over the entire length of the furnace shells 14. The lower rows of burners 20 are arranged close to the carrier devices 12 and are directed obliquely upwards, while the two upper rows of burners are offset through abut 90° to the corresponding lower rows of burners and are directed obliquely downwards. The upper rows of burners 19 are adjustable with respect to the lower rows of burners 20.

By reason of the arrangement described of the rows of burners 19, 20, during preheating of the billets 1 or 1' (smaller diameter) the surfaces are utilized in optimum manner for heat transfer so that a temperature distribution in rotational symmetry is achieved over the cross section of the billets. The burner nozzels 21 are adjusted to different outputs so that the temperature distribution desired in each case is achieved.

At the place where the carrier devices 12 for the billets 1 or 1' penetrate the gap formed between the two furnace shells they are likewise sealed by the sealing strips 53 described above.

The flue gases leave the furnace chamber 15 upwardly through the gap formed between the furnace shells 14 and the spacers 17 and are sucked off by the exhaust fans 10 through the exhaust gas passage 61 and into the gas inlet passage of furnace 50.

The pipes 28 required for mixing and metering the combustion gas and a device 29 for measuring the temperature of billets 1 or 1' are arranged at the right hand side of the furnace as seen in FIG. 9.

For preheating the ingots or billets are pushed into the furnace group from the left side in the direction of the arrow in FIG. 7 and are taken over by the carrier devices 12 which are being moved by the double-run conveyor chain 13. The drive of the double-run conveyor chain 13 is controlled by limit switches (not shown) which switch off the drive when a billet 1 runs against an abutment (not shown) at the right end of the furnace shell 14.

Measuring devices (not shown) arranged at uniform spacings over the length of the furnace shells 14 measure the length of each respective billet 1 which has been inserted. These measuring devices control the burners 19 and 20 in groups such that only a number of burners corresponding to the length of the billet is operated during the preheating.

With shorter billet lengths it is also possible to supply a plurality of billets to the furnace group 50, 60.

Operation with the furnace assembly described is more rapid than if only a quick-preheating furnace according to FIG. 9 were used because the material entering into the quick-preheating furnace 60 has already been preheated in furnace 50 to a certain temperature instead of being inserted in cold condition into the quick-preheating furnace. This permits considerable energy saving in the quick-preheating furnace.

Apart from the electrical energy required for operation of the fans 10 the preheating in furnace 50 is carried out without additional energy expenditure because the exhaust gases of the quick-preheating furnace 60 are used for this purpose.

The furnace according to FIGS. 1 to 6 or the furnace assembly according to FIGS. 7, 8, and 9 can be used especially advantageously for preheating material which is subsequently subjected to heat treatment, e.g. full annealing in a downstream holding furnace. With this kind of use the quickness and evenness of the heating of the material through and through to be achieved by the furnace or by the furnace assembly is to the direct benefit of the quality and reproducibility of the products resulting from the heat treatment.

What we claim is:

1. A preheating furnace having a furnace chamber for preheating an extended metal piece comprising:

transportation means for the metal arranged in the furnace chamber;

at least one treatment chamber in the furnace chamber for containing and treating the metal;

at least one pressure chamber in the furnace chamber into which hot gas is blown under pressure; and a plurality of rows of slot-type nozzles arranged laterally symmetrically from the metal and extending through a partition which subdivides the furnace chamber into said treatment chamber and said pressure chamber whereby hot gas is adducted to the metal so that warping of the metal is prevented, said nozzles having elongated openings disposed with the longer axis of each opening transverse to the longitudinal axis of the metal.

2. The preheating furnace of claim 1, wherein a fan cooperates with said treatment chamber to draw the hot gas out of said treatment chamber and circulate the hot gas through an outlet of the fan into said pressure chamber.

3. The preheating furnace of claim 2 wherein electrical heaters are arranged in said pressure chamber at either side of said treatment chamber.

4. The preheating furnace of claim 2 including at least one gas inlet passage communicating with said treatment chamber, and further including at least one gas outlet passage communicating with said pressure chamber.

5. A furnace group for quick preheating of metal pieces including a first preheating furnace and a second preheating furnace connected downstream adjacent the first furnace so that the exhaust gases of the second furnace provide hot gases for preheating the metal in the first furnace, wherein at least the first furnace comprises:

a furnace chamber for preheating an extended metal piece;

transportation means for the metal, arranged in the furnace chamber and operatively connected with the transportation means of an adjacent furnace;

at least one treatment chamber in the furnace chamber for containing and treating the metal;

at least one pressure chamber in the furnace chamber into which hot gas is blown under pressure; and a plurality of rows of slot-type nozzles arranged laterally symmetrically from the metal and extending through a partition which subdivides the furnace chamber into said treatment chamber and said pressure chamber whereby hot gas is adducted to the metal so that warping of the metal is prevented, said nozzles having elongated openings disposed with the lower axis of each opening transverse to the longitudinal axis of the metal.

6. The preheating furnace of claim 1 wherein a return flow passage for the hot gas issuing from each of the nozzles is provided between adjacent nozzles in each row, and wherein the width of the nozzles is between $\frac{1}{3}$ and 1/10 the distance between adjacent nozzles in each row so that a heat transfer coefficient of approximately between 100 and 200 kcal/m$^2$h° C. is achieved.

* * * * *